US006155194A

United States Patent [19]

Hoareau

[11] Patent Number: 6,155,194

[45] Date of Patent: Dec. 5, 2000

[54] PLOUGH ANCHOR

[76] Inventor: Desire Dominique Hoareau, 67 Peel Street, Mandurah, Western Australia, 6210, Australia

[21] Appl. No.: 09/355,978

[22] PCT Filed: Feb. 26, 1998

[86] PCT No.: PCT/AU98/00124

§ 371 Date: Aug. 23, 1999

§ 102(e) Date: Aug. 23, 1999

[87] PCT Pub. No.: WO98/38080

PCT Pub. Date: Sep. 3, 1998

[30] Foreign Application Priority Data

Feb. 26, 1997 [AU] Australia ..... P05322
Jun. 18, 1997 [AU] Australia ..... P07471

[51] Int. Cl.[7] ..... B63B 21/38

[52] U.S. Cl. ..... 114/304; 114/310

[58] Field of Search ..... 114/294, 297, 114/304, 307, 310, 301, 305, 300

[56] References Cited

U.S. PATENT DOCUMENTS

Re. 31,654 8/1984 Fasco ..... 114/297
3,964,420 6/1976 Stelling .
4,418,635 12/1983 Taylor .

FOREIGN PATENT DOCUMENTS

56134/80 A1 9/1981 Australia .
WO 89/09722 10/1989 WIPO .

OTHER PUBLICATIONS

Patent Abstracts of Japan, M861, p. 147, JP 01–127482 (Sojiro) May 19, 1989, Abstract, lines 4–6.

*Primary Examiner*—S. Joseph Morano
*Assistant Examiner*—Patrick Craig Muldoon
*Attorney, Agent, or Firm*—Miles & Stockbridge P.C.; John C. Kerins

[57] ABSTRACT

An improved plough anchor is provided, having an elongate shank and a plough body, the plough body having provided therein a neck portion pivotally attached to the remainder thereof and through which the elongate shank is connected thereto, the axis described by the pivotal connection of the neck portion and remainder of the plough body being tilted forward of vertical, such that upon rotation of the elongate shank with respect to the plough body the elongate shank is at its highest when not orientated along an axis described by the plough body.

13 Claims, 9 Drawing Sheets

PLOUGH ANCHOR

DESCRIPTION

The present invention relates to an improved plough anchor. More particularly, the improved plough anchor of the present invention has specific adaptations made thereto to increase its stability when in use.

FIELD OF THE INVENTION

Plough anchors are generally provided in a form comprising an elongate shank, one end of which is adapted for attachment to an anchor chain and/or rope. The other end of the shank is pivotally connected to a plough body for engagement with a sandy sea, river or lake bed surface.

Present plough anchor designs require that they be pulled by the drift of the boat to which they are attached substantially in the direction of orientation or axis of their plough body. If the shank settles or is pulled by drift of the boat away from that axis the plough body may tilt or tip rather than ploughing into the sea, river or lake bed surface.

Typically plough anchors have the shank pivotally attached to the plough body through an axis that is tilted somewhat rearwardly from the vertical. Because of this the shank when settling or being pulled away from the axis of the shank body moves closer to the sea, river or lake bed surface on which the anchor sits. This action lowers the level of attachment of the anchor chain and/or rope to the shank with respect to the pivot attachment of the shank to the plough body. This in turn contributes to the tendency of the plough anchor to tilt or tip when pulled.

The pivotal attachment of the shank to the plough body is generally achieved through a neck portion welded to the flukes of the plough body. The neck portion projects upwardly from the flukes and spaces the pivotal attachment upwardly with respect thereto. This construction also accentuates the tendency of prior art plough anchors to tilt or tip.

A further disadvantage of known plough anchors is that they cannot be used in areas in which there is any real chance of becoming snagged, for example in sea beds with some reef or rocks present.

SUMMARY OF THE INVENTION

The improved plough anchor of the present invention has as one object thereof to overcome substantially the above-mentioned problems associated with the prior art.

In accordance with a first embodiment of the present invention there is provided an improved plough anchor, the plough anchor characterised by an elongate shank and a plough body, the plough body having provided therein a neck portion pivotally attached to the remainder thereof and through which the elongate shank is connected thereto, the axis described by the pivotal connection of the neck portion and remainder of the plough body being tilted forward of vertical such that upon rotation of the elongate shank with respect to the plough body the elongate shank is at its highest when not orientated along an axis described by the plough body.

Preferably, the neck portion of the plough body is pivotally received on a shoulder plate, the shoulder plate being provided below an uppermost portion of a pair of the blades forming in part the plough body.

Still preferably, the shank is attached to the neck portion of the plough body in a pivotal manner. The axis about which the shank pivots with respect to the neck portion being substantially horizontal.

The shank and neck portion preferably cooperate such that the shank is unable to move pivotally with respect thereto without operation of a release mechanism provided in the shank. The release mechanism preferably comprises in part a locking member able to engage and disengage the neck portion. The disengaging of the locking member from the neck portion is preferably achieved in response to manipulation of an anchor line attached to the shank by a user.

In accordance with a second embodiment of the present invention there is provided an improved plough anchor, as described hereinabove, characterised in that the neck portion has provided thereon or thereabouts at least a pair of stabilising arms.

Preferably, the stabilising arms project in both a rearward and lateral manner and are arranged such that if the plough anchor settles in a position wherein the stabilising arms are in contact with a surface the pull of a drifting vessel through the shank acts to right the plough anchor such that blades provided on the plough body will plough into the surface.

Still preferably, a further stabilising member may be provided extending from or about the neck portion in an upward manner whereby if the plough anchor settles in a position wherein the stabilising member is in contact with a surface, the pull of a drifting vessel through the shank acts to right the plough anchor through the combined action of the stabilising member and the stabilising arms.

BRIEF DESCRIPTION OF THE DRAWINGS

The improved plough anchor of the present invention will now be described, by way of example only, with reference to two embodiments thereof and the accompanying drawings, in which.

DESCRIPTION OF THE INVENTION

Figure 1:
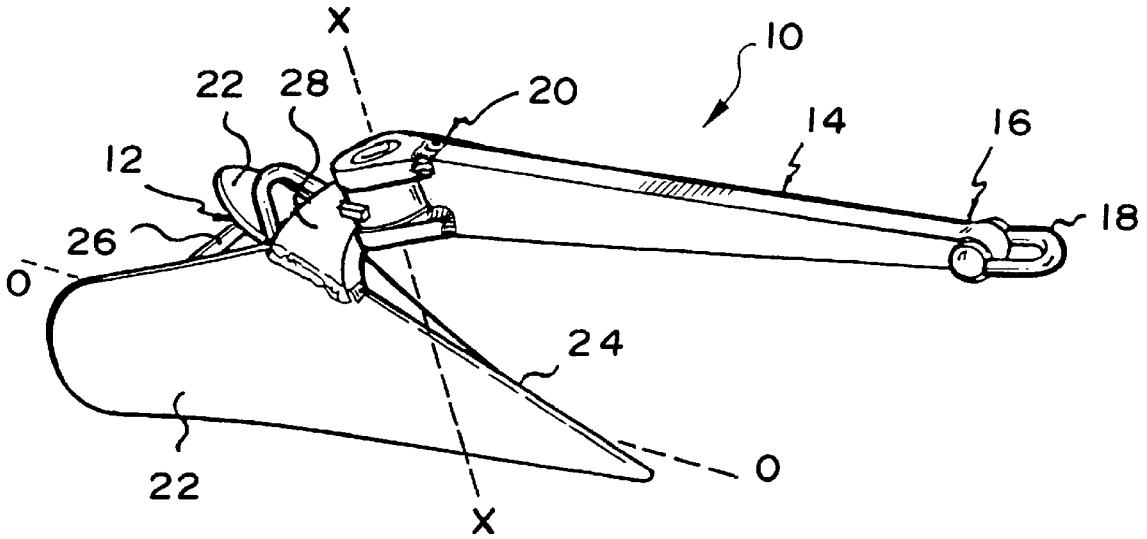
Fig. 1 PRIOR ART
FIG. 1 is an upper perspective view of a prior art plough anchor.
Figure 2:
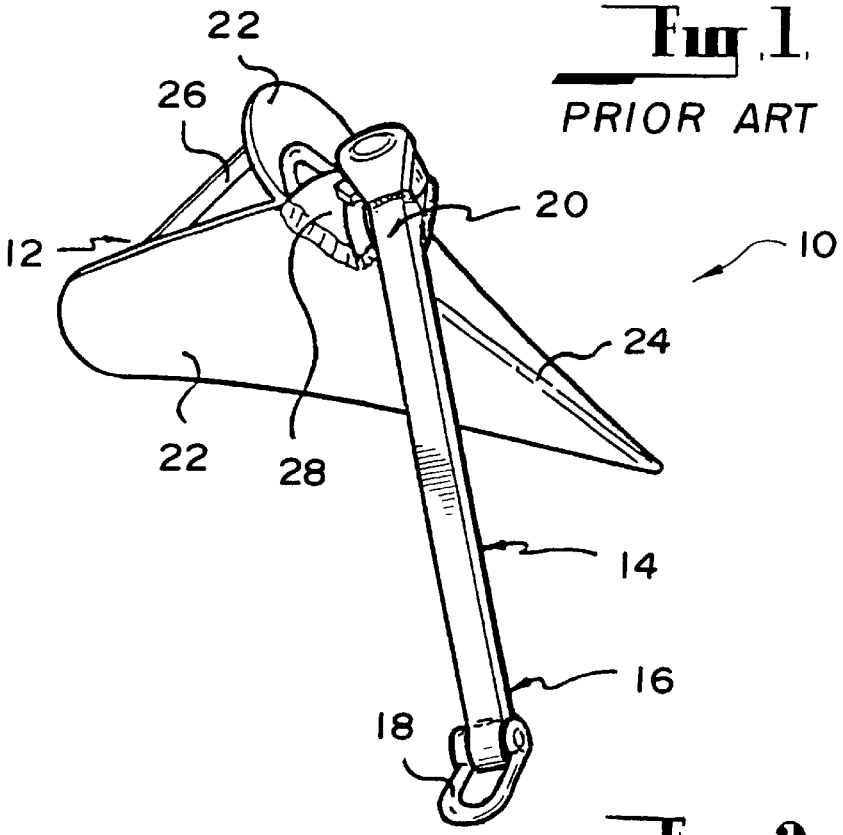
Fig. 2 PRIOR ART
FIG. 2 is an upper perspective view of the prior art plough anchor of FIG. 1.

In FIGS. 1 and 2 there is shown a prior art plough anchor 10 comprising a plough body 12 and an elongate shank 14. A first end 16 of the shank 14 has a shackle 18 provided thereat for attachment thereto of an anchor line (not shown). A second end 20 of the shank 14 is pivotally connected to the plough body 12 and is arranged to pivot about an axis X—X, as shown in FIG. 1.

The plough body 12 comprises a pair of blades 22 joined along their uppermost edges 24 and together providing the general form of a plough. The blades 22 generally describe an axis O—O of orientation, as shown in FIG. 1. The blades 22 have a reinforcing member 26 provided between their rearmost points.

A neck portion 28 is attached to the blades 24 at their uppermost edge 24 and projects upwardly and partially forward. The neck portion 28 terminates in the pivotal connection to the second end 20 of the shank 14.

Figure 3:
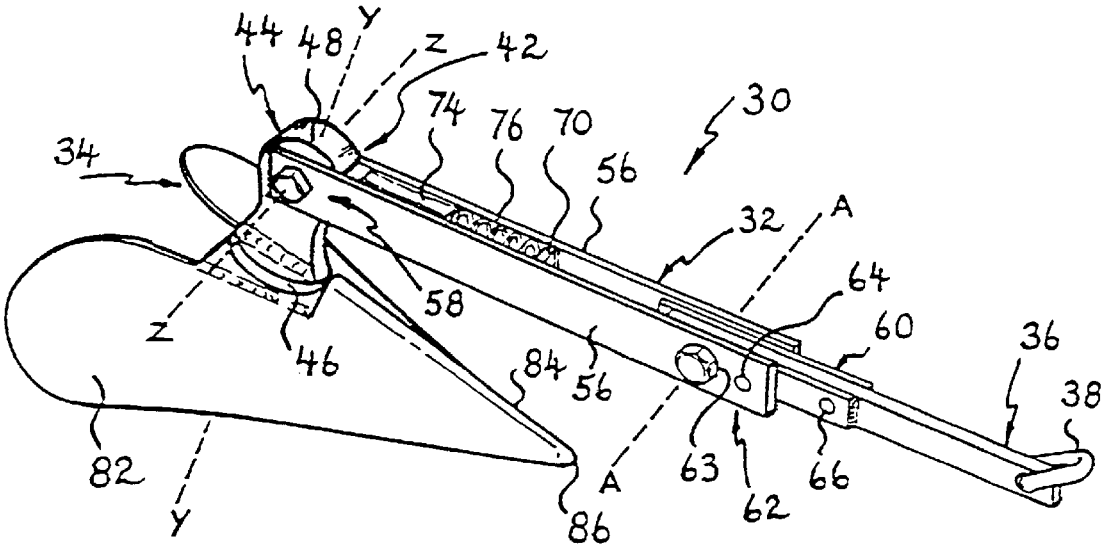
FIG. 3 is an upper perspective view of a plough anchor in accordance with a first embodiment of the present invention.

In FIGS. 3 to 9 there is shown a plough anchor 30 in accordance with the present invention. The plough anchor 30 comprises an elongate shank 32 and a plough body 34. The shank 32 has a first end 36 at which is provided a shackle 38 for attachment to an anchor line 40. A second end 42 of the shank 32 is pivotally connected to a neck portion 44 of the plough body 34 for rotation about an axis Z—Z, as shown in FIG. 3.

Figure 8:
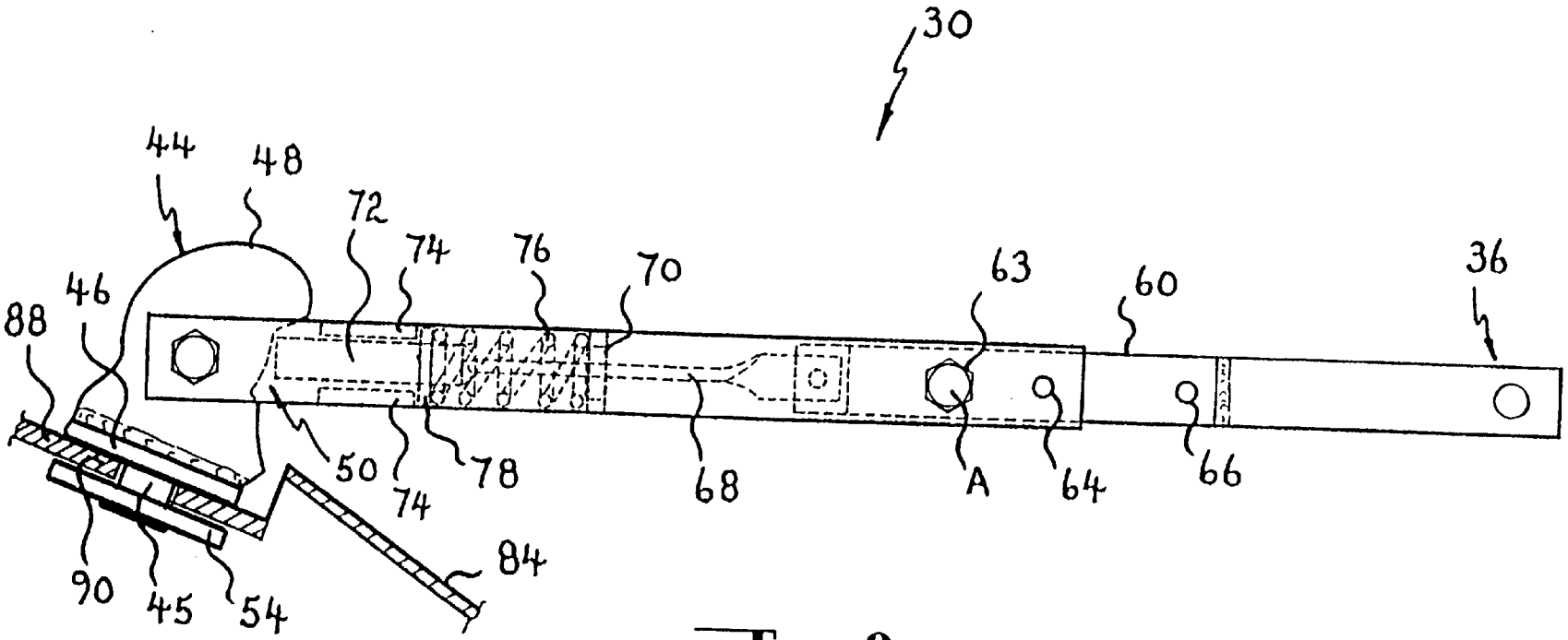
FIG. 8 is a partial cut-away side elevational view of the neck portion of the plough body and shank of the plough anchor of FIG. 3.
Figure 9:
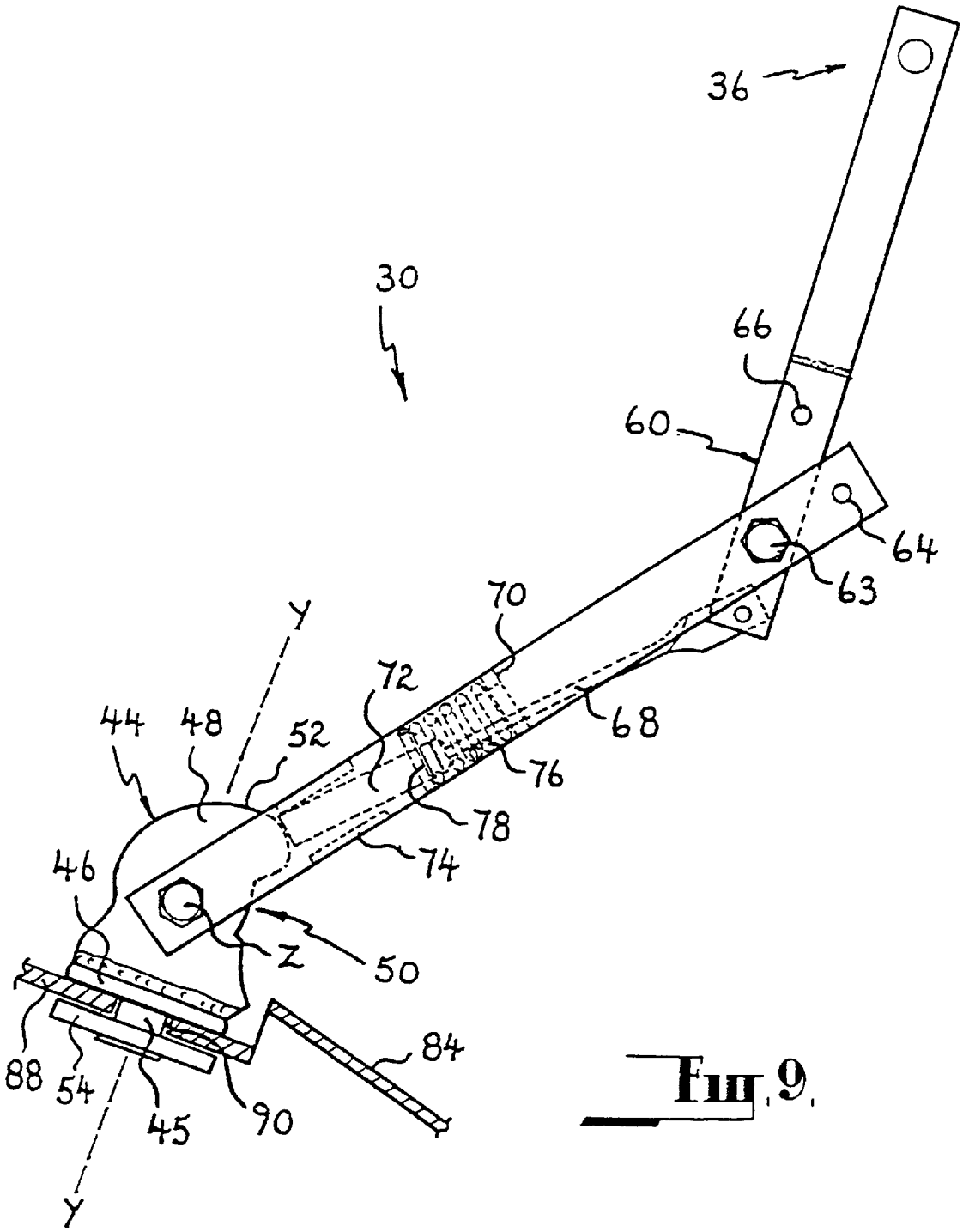
FIG. 9 is a partial cut-away side elevational view of the neck portion of the plough body and shank of the plough anchor of FIG. 3 showing the locking member disengaged from the neck portion and showing the shank pivoting with respect thereto.

The neck portion 44 comprises a collar 46 from which a spigot 45 extends downwardly and a head 48 to which the shank 32 is pivotally attached. The head 48 defines in its outer surface a recess 50 and a cam surface 52. Importantly, the recess 50 is not spaced as far apart from the axis Z—Z as is the cam surface 52. A retaining member 54 is provided about the spigot 45, as best seen in FIGS. 8 and 9, to positively locate the spigot 45 with respect to the shoulder plate noted later.

The shank 32 comprises a pair of elongate lateral members 56 received at one end 58 about the neck portion 44. A pivot block 60 is held between the other ends 62 of the lateral members 56 in a pivotal manner by way of bolt 63 describing an axis A—A. A locking pin (not shown) may be received through apertures 64 provided in the ends 62 and the block 60 so as to lock the block 60 relative to the members 56. If the locking pin is not received therethrough it may be stored through an aperture 66 provided in the block 60, as seen in FIG. 3. A releasing arm 68 is attached to the block 60 and extends between the lateral members 56, through a guide 70 provided between the members 56 and forms a locking member 72. The locking member 72 is received between guide plates 74, best seen in FIGS. 8 and 9. A flexibly resilient member, for example a compression spring 76 is provided about the releasing arm 68 and is seated at one end on the guide 70 and at the other on a pin 78 received through the locking member 72. The spring 76 acts to bias the locking member 72 into engagement with the neck portion 44.

Figure 5:
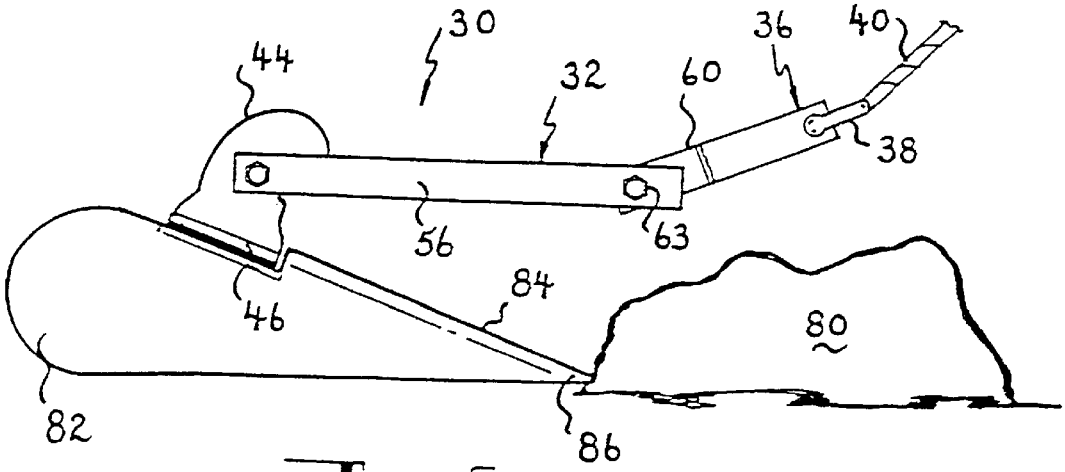
FIG. 5 is a side view of the plough anchor of FIG. 3 shown in use and engaging a rock or reef.
Figure 6:
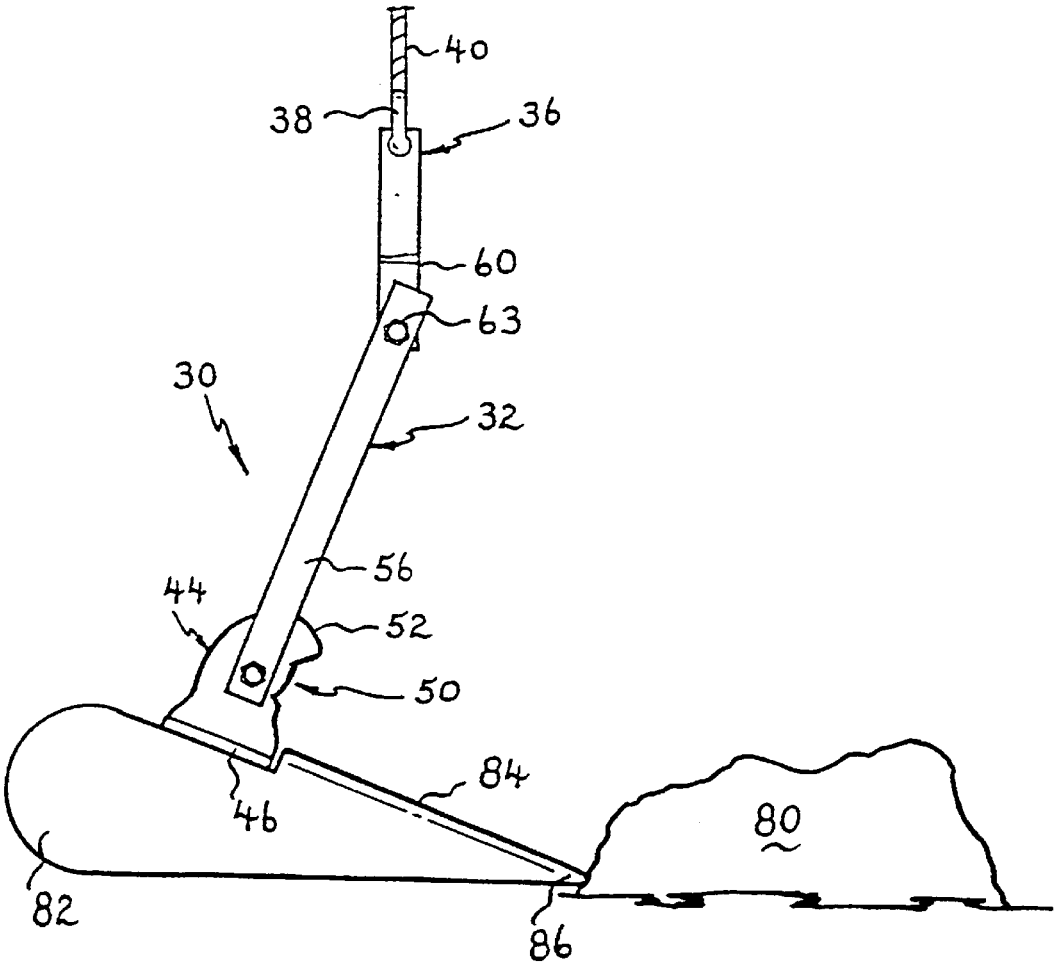
FIG. 6 is a side view of the plough anchor and rock of FIG. 5 showing the pivotal nature of the shank with respect to the neck portion of the plough body.
Figure 7:
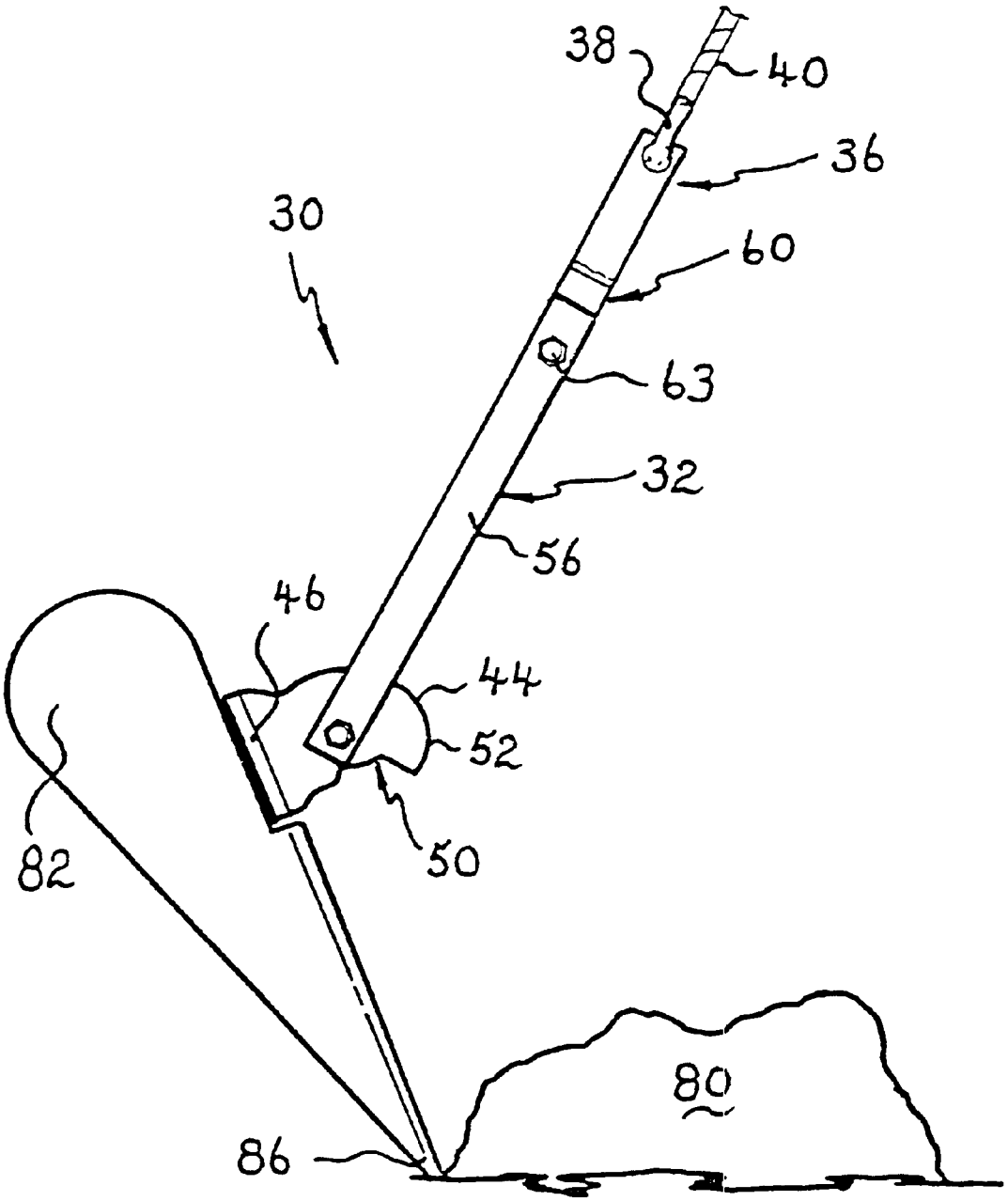
FIG. 7 is a side view of the plough anchor and rock of FIGS. 5 and 6 showing how the plough anchor may be pulled free of the rock.

In FIGS. 5 to 7 there is shown the plough anchor 30 engaging a rock 80 (FIG. 5) and being released therefrom (FIGS. 6 and 7).

The plough body 34 comprises a pair of blades 82 formed from a single sheet of material, for example steel. A ridge 84 is formed where the blades 82 meet and diverge. The blades 82 further define a point 86. A shoulder plate 88 is recessed from the ridge 84 and extends between the blades 82. The plate 88 seats the neck portion 44 and receives through an aperture 90 provided therein the spigot 45 thereof.

Figure 10:
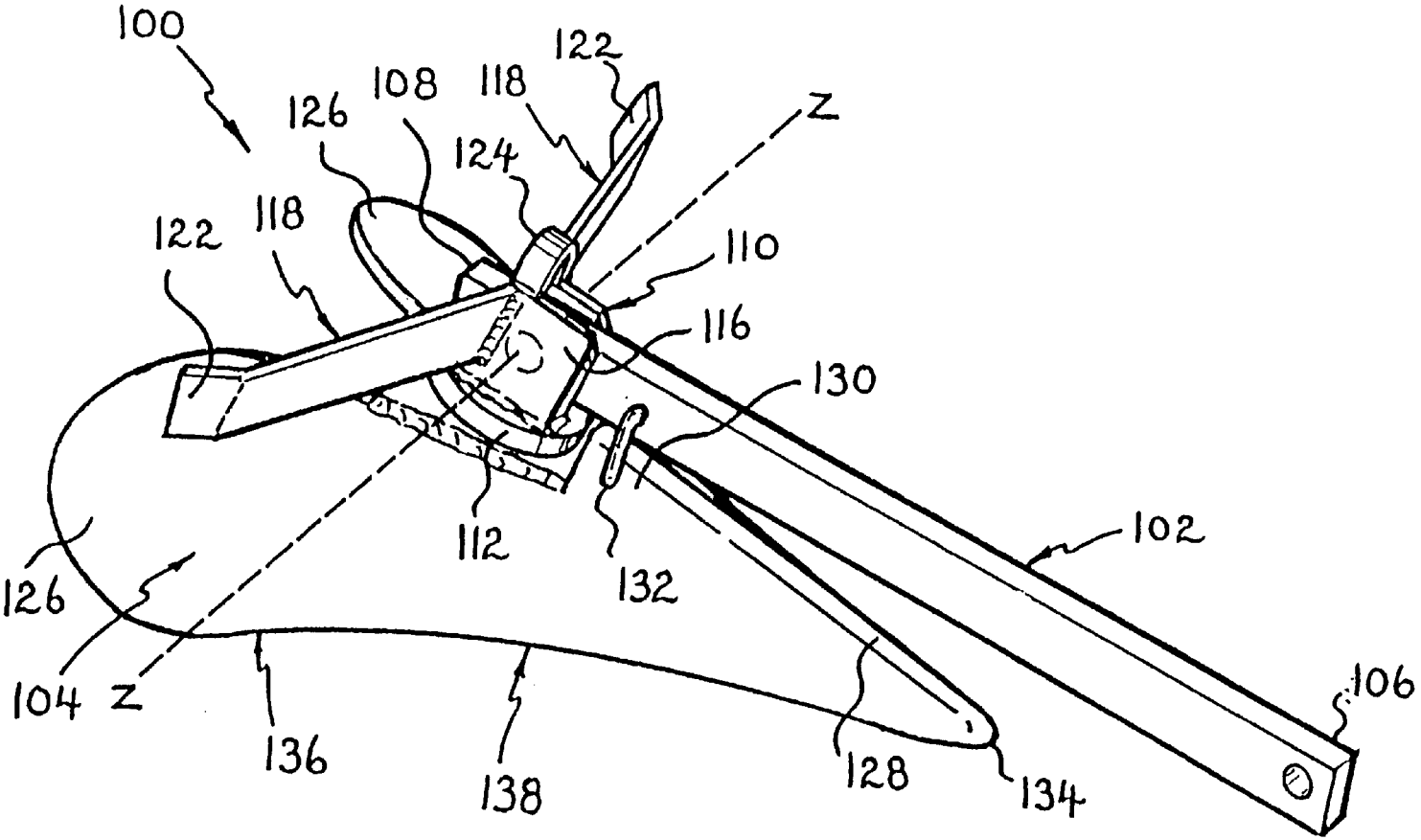
FIG. 10 is an upper perspective view of an improved plough anchor in accordance with a second embodiment of the present invention and showing the shank thereof in an at rest position.
Figure 11:
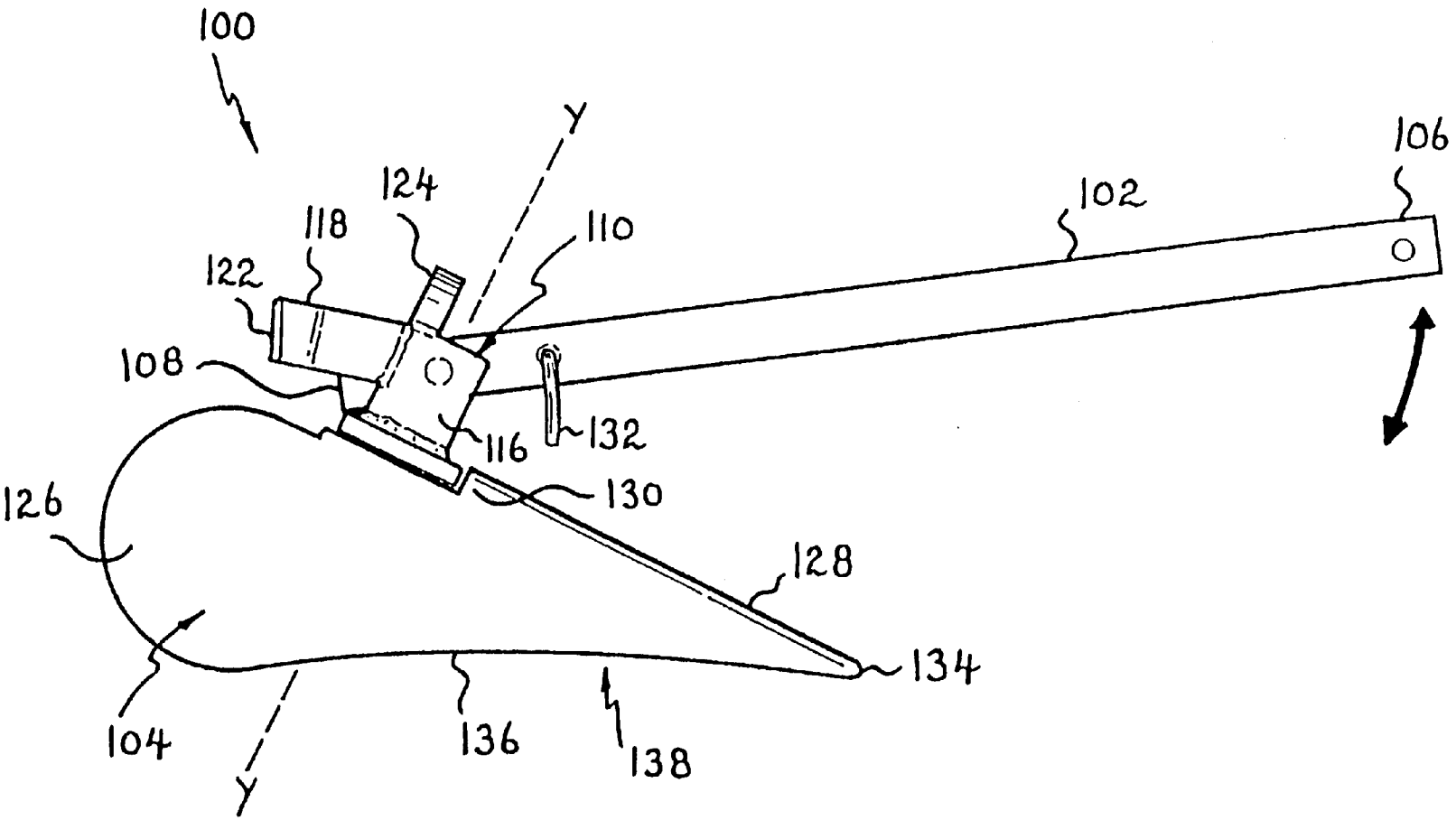
FIG. 11 is an upper perspective view of the stable plough anchor of FIG. 10 showing the shank thereof in an "active" position.
Figure 12:
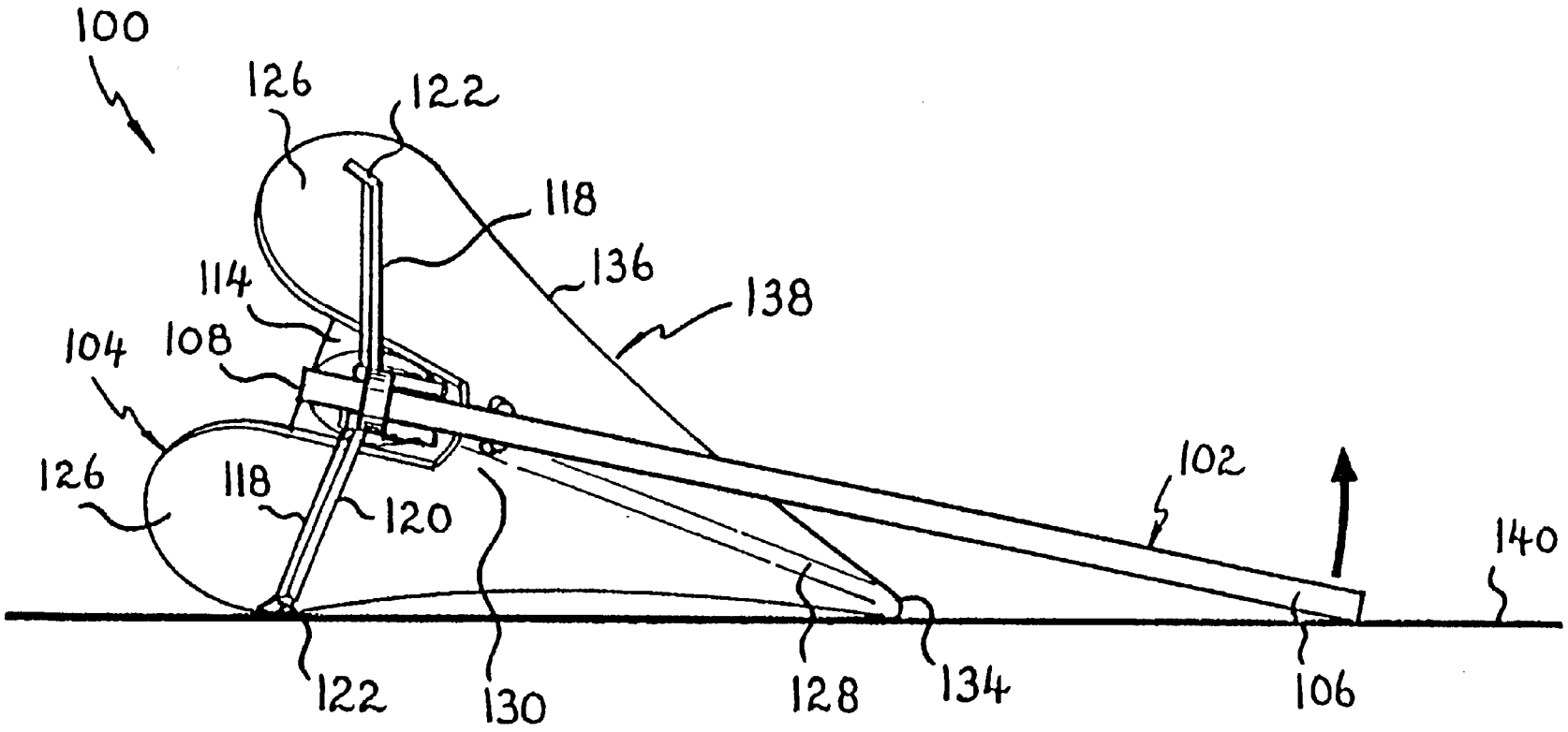
FIG. 12 is an elevational side view of the stable plough anchor of FIG. 10 illustrating how pull applied through the shank acts to right the stable plough anchor.

In FIGS. 10 to 12 there is shown an improved plough anchor 100 in accordance with a further embodiment of the present invention. The plough anchor 100 comprises an elongate shank 102 and a plough body 104. The elongate shank 102 has a first end 106 to which a shackle may be provided for attachment to an anchor line. The shank 102 has a second end 108 through which the elongate shank 102 is pivotally connected to a neck portion 110 of the plough body 104 for rotation about an axis Z—Z, as shown in FIG. 10.

The neck portion 110 comprises a collar 112 from which extends downwardly a spigot (not shown). The spigot is received through an aperture in a base plate 114 in a rotatable manner. A retaining member (not shown) is provided about the spigot to positively locate the spigot with respect to the aperture and plate 114.

The neck portion 110 further comprises a pair of upstanding and opposed flanges 116, and between which the second end 108 of the elongate shank 102 is received. The flanges 116 define between them a pivot point such that the elongate shank 102 may rotate or pivot about the axis Z—Z. The flanges 116 each have projecting therefrom a first stabilising arm 118. The stabilising arms 118 comprise a first portion 120 that extends laterally and rearwardly of the neck portion 110, and a terminal portion 122 offset with respect to the first portion 120, as can be seen best in FIGS. 10 and 12. Importantly, the second portion 122 of the stabilising arms 118 is offset rearwardly with respect to the first portion thereof.

The neck portion 110 is further provided with a stabilising member 124 extending in an upwardly arched manner between the flanges 116 thereof.

The arrangement of the neck portion 110 on the plate 114 allows rotation of the neck portion 110 and elongate shank 102 with respect to the remainder of the plough body 104 about an axis Y—Y, as shown in FIG. 11. The plough body 104 further comprises a pair of blades 126 joined along their upper most edges 128 and together providing the general form of a plough. The plate 114 is provided in a bridging manner between the blades 126 and defines with the uppermost edges 128 of the blades 126 a raised ridge 130 with respect to the plate 114 and collar 112. The elongate shank 102 has provided thereon a pair of downwardly depending locating members 132 located such that they may engage the ridge 130 of the blades 126. Preferably, the locating members 132 are provided adjacent to but forward of the neck portion 110, as can be seen with reference to the accompanying figures.

The blades 126 are joined along their upper most edges 128 as indicated previously and at the forward most end thereof form a nose or point 134. When reference is made throughout the specification to orientation is to be considered with respect to the orientation of the stable plough anchor 100 herein described. The blades 126 have a lowermost edge 136 and which has provided therein an arcuate portion 138. A similar arcuate portion may be provided in a lowermost edge of the blades 82 of the plough anchor 30.

In FIG. 12 there is shown the improved plough anchor 100 at rest on a surface 140 which may be perhaps a sea bed or a river bed. The improved plough anchor 100 is shown with one blade 126 thereof and one stabilising arm 118 thereof and the first end 106 of the elongate member 102 thereof engaging the surface 140. It is to be noted that in this position the arcuate form of the lower most edge 136 of the blades 126 provide a generally forward and downward inclination to the plough body 104 as a whole.

In use, the prior art plough anchor 10 may settle on a sea bed with the plough body 12 lowermost as shown in FIGS. 1 and 2. The intended use for the plough anchor 10 is that the plough anchor 10 will dig into the sea bed when pulled by drift of the boat through the ploughing action generated by the blades 22 of the plough body 12. The blades 22 have a tendency to pull the plough anchor 10 downwards into the sea bed. However, if upon deployment of the plough anchor 10 the shank 14 settles so as to be out of alignment with the general axis of the plough body 12, the axis being labelled O—O in FIG. 1, then a pulling force applied on the shank, perhaps by drifting of the boat, can cause the plough anchor 10 to tip or tilt over rather than producing the action of ploughing into the sea bed on which it rests. This tipping or tilting action is induced as the pivotal attachment between the shank 14 and the neck portion 28 is raised with respect to the plough body 12 and is accentuated by the fact that the axis of pivotal connection X—X between the shank 14 and the neck portion 28 is tilted rearwardly of the vertical, as shown in FIG. 1. This arrangement results in the first end 16 of the shank 14 moving to a point lower than the pivotal connection between the shank 14 and the neck portion 28 when such is moved from the axis O—O of the plough body 12, as is seen in FIG. 2. Accordingly, a pulling force applied to the shank 14 results in the tipping or tilting movement of the plough anchor 10.

Figure 4:
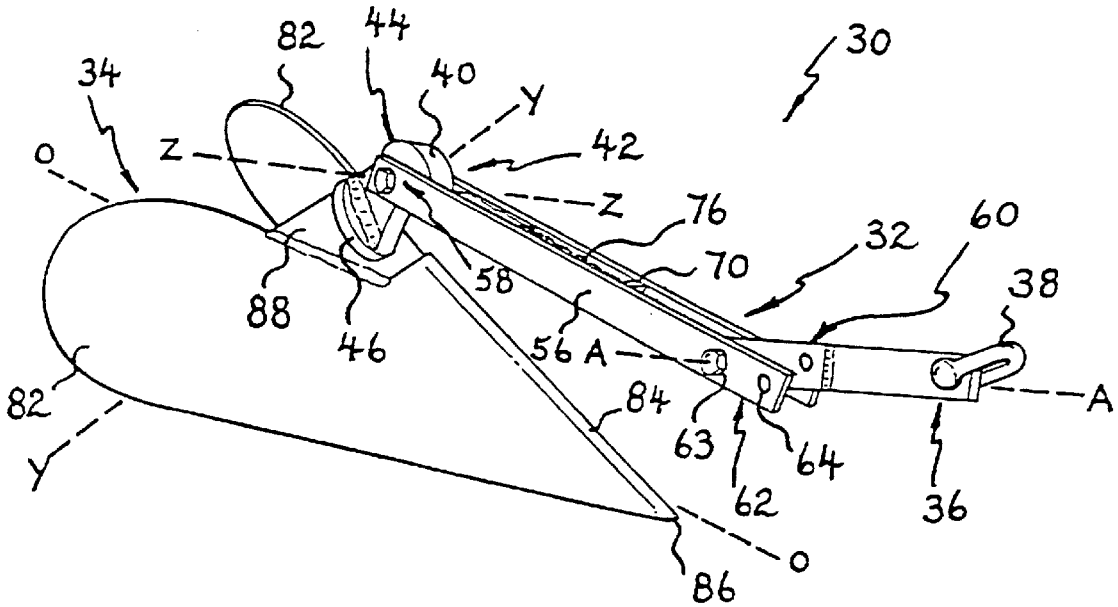
FIG. 4 is an upper perspective view of the plough anchor of FIG. 3 with the shank rotated with respect to the plough body.

The plough anchor 30 of the present invention in use is deployed in a similar manner from a boat as is plough anchor 10 of the prior art. When initially deployed the plough anchor 30 has the locking mechanism of the elongate shank 32 in the position shown in FIG. 8 as engaged with the neck portion 44. Due to the manner in which the shank 32 is engaged with the neck portion 44 and the manner in which the neck portion 44 is attached to the remainder of the plough body 34 the tipping or tilting action evident in the prior art plough anchor 10 is generally not present. Upon the shank 32 moving away from the orientation of axis O—O the first end 36 thereof moves to a point higher than it was when oriented about the axis O—O, in fact, the first end 36 of the shank 32 moves to a point higher than the pivotal connection between the neck portion 44 and the shank 32, as is shown in FIGS. 3 and 4. In this manner a pulling force applied to the shank 32 even when not oriented about the axis O—O will produce a ploughing action from the blades 82 of the plough body 34 rather than the tipping or tilting action demonstrated in the prior art plough anchor 10.

The plough anchor 30 achieves the above result through providing the neck portion 44 with a pivotal attachment to the remainder of the plough anchor body 34 about axis Y—Y. The axis Y—Y is oriented forwardly of the vertical which results in the first end 36 of the shank 32 being higher than the pivotal attachment between the shank 32 and the neck portion 44 upon rotation thereof away from the axis O—O. Further, the manner in which the pivotal attachment between the neck portion 44 and the shoulder plate 88 is positioned at a point lower than the uppermost point of the blades 82 accentuates the ploughing action of the plough anchor 30. In effect, the point of which the pulling force applied to the shank 32 is transferred to the plough body 34 is lower in use than the pivotal attachment between the shank 32 and the neck portion 44 and is rather located at the point where the spigot 45 of the neck portion 44 is received through the shoulder plate 88.

Upon the plough anchor 30 becoming snagged upon a rock 80, as shown in FIGS. 5 to 7, a user (not shown) can cause the release of the plough anchor 30 from that rock 80. For example, the user pulls on the anchor line 40 until they are located almost directly above the plough anchor 30, as shown in FIG. 6. The upward pulling action exerted on the end 36 of the shank 32 causes the block 60 to pivot about the bolt 63 or axis A—A. The block 60 rotates about the axis A—A providing a pulling action on the releasing arm 68 which in turn acts to compress the spring 76 between the pin 78 and the guide 70 and so as to release the locking member 72 from the recess 50 of the neck portion 44. This in turn allows the locking member 72 to pass over the cam surface 52 of the neck portion 44 and allows the shank 32 to rotate with respect to the neck portion 44 and about the axis Z—Z, as is best seen in FIGS. 3 and 9.

As the shank 32 rotates with respect to the neck portion 44 the plough body 34 is able to lift free of the rock 80 on which it was snagged, as shown in FIG. 7. This allows the plough anchor 30 to be retrieved by the user.

The user can negate the releasing action of the plough anchor 30 by providing a locking pin through aperture 64 in the shank 32 and block 60. This prevents the block 60 pivoting with respect to the remainder of the shank 32 about axis A—A.

It is envisaged that an amount of lead may be provided between the blades 82 of the plough anchor 30 adjacent the point 86 thereof so as to accentuate the ploughing action of the plough anchor body 34. It is still further envisaged that the construction of the blades 82 from a single sheet of steel aides in the strength thereof thereby providing a plough anchor 30 with a longer life when compared with prior art plough anchors. It is still further envisaged that a reinforcing member may be provided between the blades 82 and that such may be provided as a piece of flat bar angled downwardly so as to again accentuate the ploughing action of the plough anchor 30.

It is known that anchors generally do not always locate themselves in the best manner for anchoring the vessel to which they are attached when first deployed. For example, a plough anchor may either not align itself correctly with the direction of drag of the vessel from which it was deployed or may simply land upsidedown or on its side, as shown for example in FIG. 12. The improved plough anchor 100 of the present invention addresses many of these problems.

The interaction of the locating members 132 and the ridge 130 prevents rotation of the elongate shank 102 about the axis Y—Y unless the elongate shank 102 is in a raised position as shown in FIG. 11. In this raised position the locating members 132 are disengaged from the ridge 130 to allow rotation of the neck portion 110 and consequently the elongate shank 102 about the axis Y—Y.

As is shown in FIG. 12, the stabilising arms 118 act to prevent the improved plough anchor 100 from rolling upside down although the upwardly extending arched member 124 acts to prevent the improved plough anchor 100 resting in an upside down position. Further, this arrangement causes the anchor 100 to move towards its preferred position having the lower most edges 136 of the blades 126 engaging the surface 140 and in which the point 134 is located so as to dig into the surface 140. The arcuate portion 138 provided in each blade 126 further aids in the ploughing action of the anchor 100.

The orientation of the stabilising arms 118 with respect to the remainder of the stable plough anchor 100 is seen to contribute to the efficiency of the invention.

In particular the provision of the terminal second portions 122 of the stabilising arms 118 acts specifically to abut the surface 140, as shown in FIG. 12, and upon lifting of the elongate shank 102 to promote rolling of the plough body 104 such that the lower most edge 136 of the blades 126 engage the surface 140.

The engagement in between the locating members 132 and the ridge 130 ensures that if the vessel from which the stable plough anchor was deployed drifts about the axis Y—Y that the sideways rotation of the elongate shank 102 imparted by the vessel is transferred through to the body portion 104 and the blades 126. The locating members engage the ridge 130 and in effect turn or rotate the nose 134 in the direction of the drift of the vessel whereby the stable plough anchor 100 may again, under the influence of the vessel, plough into the surface 140.

It is envisaged that an amount of lead may be provided between the blades of the improved plough anchor 100 so as to accentuate the ploughing action of the plough anchor body 104. It is still further envisaged that the construction of the blades from a single sheet aids in the strength thereof providing a stable plough anchor 100 with a longer life when compared with prior art plough anchors. It is still envisaged that a reinforcing member may be provided between the blades 126 and that such may be provided as a piece of flat bar extending between the lower most edges of the blades 126. The reinforcing member may in this manner accentuate the ploughing action of the stable plough anchor 100.

It is to be appreciated that differing sizes of the plough anchors 30 and 100 will be best suited to differing sizes of boats.

It is further to be understood that the various features of the improved plough anchors 30 and 100 may be combined or interchanged as desired in a single plough anchor, without departing from the spirit of the present invention.

Throughout this specification, unless the context requires otherwise, the word "comprise", or variations such as "comprises" or "comprising", will be understood to imply the inclusion of a stated integer or group of integers but not the exclusion of any other integer or group of integers.

Modifications and variations such as would be apparent to the skilled addressee are considered to fall within the scope of the present invention.

What is claimed is:

1. A plough anchor comprising an elongate shank and a plough body, said plough body having an axial extent and said plough body having a neck portion pivotally attached to a remainder of said plough body and through which the elongate shank is connected thereto, said pivotal connection of the neck portion and said remainder of said plough body defining an axis which is titled forward of vertical such that, upon rotation of the elongate shank with respect to the plough body, the elongate shank is at its highest when not oriented along said axial extent of said plough body.

2. A plough anchor according to claim 1, wherein the neck portion of the plough body is pivotally received on a shoulder plate, the shoulder plate being positioned below an uppermost portion of a pair of blades of said plough body.

3. An improved plough anchor according to claim 2, wherein a lowermost edge of each of said pair of blades of the plough anchor has an arcuate portion provided therein.

4. A plough anchor according to claim 2, wherein the elongate shank is attached to the neck portion of the plow body in a pivotal manner.

5. A plough anchor according to claim 4, wherein an axis about which the shank pivots with respect to the neck portion is substantially horizontal.

6. A plough anchor of according to claim 1, wherein the elongate shank is attached to the neck portion of the plough body in a pivotal manner.

7. A plough anchor according to claim 6, wherein an axis about which the shank pivots with respect to the neck portion is substantially horizontal.

8. A plough anchor according to claim 6, wherein the elongate shank is provided with a release member, and wherein said elongate shank and said neck portion are so constructed and arranged such that the shank is unable to move pivotally with respect to said neck portion without operation of said release mechanism.

9. A plough anchor according to claim 8, wherein the release mechanism preferably comprises a locking member operable to engage and disengage the neck portion.

10. A plough anchor according to claim 9, wherein a disengaging of the locking member from the neck portion is achieved in response to manipulation of an anchor line attached to the shank by a user.

11. A plough anchor according to claim 1, wherein the neck portion is operatively coupled to at least a pair of stabilizing arms.

12. A plough anchor according to claim 11, wherein said at least said pair of stabilizing arms project in both a rearward and lateral manner, and are so constructed and arranged that when the plough anchor settles in a position wherein the stabilizing arms are in contact with a surface, the pull of a drifting vessel through the shank operates to right the plough anchor such that the blades provided on the plough body will plough into the surface.

13. A plough anchor according to claim 11, wherein a further stabilizing member is provided extending from or about the neck portion in an upward manner, whereby, when the plough anchor settles in a position wherein the stabilizing member is in contact with a surface, the pull of a drifting vessel through the shank acts to right the plough anchor through the combined action of the stabilizing member and the stabilizing arms.

* * * * *